United States Patent [19]

Barkans et al.

[11] Patent Number: 4,988,985

[45] Date of Patent: Jan. 29, 1991

[54] METHOD AND APPARATUS FOR A SELF-CLEARING COPY MODE IN A FRAME-BUFFER MEMORY

[75] Inventors: Anthony C. Barkans, Woburn; Jorge Lach, Arlington, both of Mass.

[73] Assignee: Schlumberger Technology Corporation, Houston, Tex.

[21] Appl. No.: 384,877

[22] Filed: Jul. 24, 1989

Related U.S. Application Data

[63] Continuation of Ser. No. 8,868, Jan. 30, 1987, abandoned.

[51] Int. Cl.[5] ..... G09G 5/30

[52] U.S. Cl. ..... 340/750; 340/799; 340/703; 340/793

[58] Field of Search ..... 340/720, 732, 744, 748, 340/750, 789, 798, 799, 801, 701, 703, 793; 365/230.08

[56] References Cited

U.S. PATENT DOCUMENTS

| | | | |
|---|---|---|---|
| 4,236,228 | 11/1980 | Nagashima et al. | 340/799 |
| 4,475,104 | 10/1984 | Shen | 340/703 |
| 4,509,043 | 4/1985 | Mossaides | 340/703 |
| 4,559,535 | 12/1985 | Watkins et al. | 340/793 |
| 4,595,917 | 6/1986 | McCallister et al. | 340/798 |
| 4,613,852 | 9/1986 | Maruko | 340/799 |
| 4,633,416 | 12/1986 | Walker | 340/798 |
| 4,635,049 | 1/1987 | Dodge et al. | 340/801 |
| 4,646,078 | 2/1987 | Knierim et al. | 340/750 |
| 4,648,050 | 3/1987 | Yamagami | 340/703 |
| 4,663,619 | 5/1987 | Staggs et al. | 340/799 |
| 4,673,930 | 6/1987 | Bujalski et al. | 340/750 |
| 4,679,038 | 7/1987 | Bantz et al. | 340/750 |
| 4,688,190 | 8/1987 | Bechtolsheim | 340/799 |
| 4,691,295 | 9/1987 | Erwin et al. | 340/750 |
| 4,692,759 | 9/1987 | Phan Van Cang | 340/750 |
| 4,742,474 | 5/1988 | Knierim | 340/799 |

OTHER PUBLICATIONS

Texas Instruments System Processor TMS34010, 1986, P1-18.

Quad Pixel Dataflow Manager (QPDM) AM95C60, Technical Manual, P1-13.

*Primary Examiner*—Jeffery A. Brier
*Assistant Examiner*—Richard A. Hjerpe
*Attorney, Agent, or Firm*—Ladas & Parry

[57] ABSTRACT

A three-dimensional frame-buffer memory organized into a series of planes each storing one bit representative of a pixel on the display can draw a figure onto one of the planes. The figure can then be copied to preselected ones of the other planes while the first plane is cleared. A bit block transfer can be performed from an "invisible" portion of the first plane to pre-selected ones of the other planes.

4 Claims, 5 Drawing Sheets

METHOD AND APPARATUS FOR A SELF-CLEARING COPY MODE IN A FRAME-BUFFER MEMORY

This is a continuation of copending application Ser. No. 07/008,868 filed on Jan. 30, 1987, now abandoned.

BACKGROUND OF THE INVENTION

This invention relates to a method and apparatus for copying an image stored in one portion of a frame-buffer memory to another portion of the memory in which the first image is self-cleared. In particular, it pertains to a frame-buffer memory apparatus and a method for operating the memory for use with a CRT raster-scanned display when used in a computer graphics system.

The typical display device for a computer system, the CRT, is a raster-scanned device which has no inherent memory. The image that is to appear each time the raster is scanned must be generated by an outside source. Where this image is to be maintained on the screen, such as in a computer graphics system, the information is typically stored in a digital memory. Semiconductor memories are low enough in cost that raster-scanned frame-buffer memories are commonly used. In a frame-buffer memory, each location in the memory corresponds to one picture element on the screen, hereinafter referred to by its common technical term "pixel". This type of memory allows the display hardware to be insensitive to the image content, an arbitrary image can be displayed by properly recording the data at each location in the frame-buffer memory. If it is only necessary to store the presence or absence of illumination of that particular pixel, a two-dimensional memory array is sufficient. If, however, it is desired to control the intensity of the illumination and/or the color of that particular pixel, then a three-dimensional memory is required. In the three-dimensional memory, each location stores a word which is used to store the information to control the intensity and/or color of the pixel. Each time the raster on the CRT is scanned, the video signal to refresh the display is generated from the memory.

Frame-buffer memories were developed as an extension of the memories utilized in general-purpose computers. Accordingly, a typical frame-buffer memory in the prior art was organized into 16 bit words where each bit in the word represents one pixel on the screen. The 16 pixels thus represented by one word of memory were chosen so that they all lie one next to the other along a horizontal scan line of the CRT display. Where a three-dimensional frame-buffer memory is utilized, the memory is typically organized into a series of identical planes. The corresponding location in memory on each plane stores one bit which defines the color and/or the intensity of the illumination of a single pixel. Thus, to obtain the necessary information to illuminate a particular pixel, it is necessary to read the data from the appropriate bit in the word on each of the planes in the three-dimensional memory.

The circuitry which generates the drawing in the frame-buffer memory and thus on the display is generally called a drawing processor. In a lower performance device such as a personal computer, a single microprocessor which is also utilized to run the application program can be utilized to set, clear, AND, OR, and complement bits within the frame-buffer memory to generate the drawing. A higher level approach, such as may be utilized in a computer graphics system, is to utilize a dedicated drawing processor for this task. The drawing processor may be an off-the-shelf part, such as a graphics display controller (GDC) NEC model 7220 manufactured by Nippon Electric Company or it may be built from custom hardware. The highest level approach performs the same job utilizing several drawing processors in parallel to achieve a higher drawing speed.

It should be noted that the development of frame-buffer memories as an extension of the memories utilized in general-purpose computers led in turn to the development of off-the-shelf drawing processor integrated circuits which utilize this memory organization. The great cost saving that such integrated circuit processors provide led to their widespread use. Thus, the operation of frame-buffer memories became tightly linked to the operation of memories for general purpose computers.

As computer graphics became more advanced, there was a need to display symbols or icons on the screen. For example, if the computer graphics system were being utilized to design a digital logic system, the symbols to be displayed would be the logic gates, etc. utilized to construct the logic circuit. It is also common to utilize icons, which are specialized symbols that represent user-selectable functions to be performed by the computer. Thus, it is only necessary to position the cursor on or next to the icon to select the desired function. These symbols and icons may be complex enough and utilized often enough that it is undesirable to have the drawing processor perform the calculations and generate the symbol each time it is to be utilized. Accordingly, a function known as bit block transfer is commonly used. In bit block transfer, the symbol or icon is written into a special portion of the memory which is not utilized to refresh the display. The symbol can be written into a predetermined portion of this "invisible" memory once at the start of the program. Each time the symbol is to be utilized, the symbol is copied from that portion of the memory into the desired portion of the frame-buffer memory and the symbol becomes visible on the display at the desired location. While the symbol may be erased or replaced with another symbol, normally the preselected portion of the "invisible" memory is utilized as a read-only memory to provide the same symbol for use over and over again.

Bit block transfer solves the problem for small, repetitively used symbols. However, it is not generally useful for drawing large, irregularly shaped figures which will not be repetitively used because this would require an "invisible" memory the size of the frame-buffer memory. These figures could be generated, for example, by a program to generate the mask for producing a printed circuit board or a layer of an integrated circuit. These highly complex and generally full-screen figures take a relatively long time to draw when compared to the time required for other computer functions. Thus, the operator is forced to endure the slow on-screen drawing of the figure. In addition to be annoying to the skilled operator, this ties up the operator and the system for the time required to draw the figure.

One known solution to this problem is to utilize one of the planes of a three-dimension frame-buffer memory as a specialized drawing plane. For example, in a frame-buffer memory storing 12 bits to represent each pixel, and therefore having 12 planes, one plane would be utilized as the specialized drawing plane and the other 11 planes utilized in a normal manner to refresh the image on the display. Thus, the complex figure can be drawn in a mode which is "transparent" to the operator; that is, without the operator being aware of this operation. When the drawing processor has completed the complex figure, the figure can be copied to other memory planes in order to provide the color and/or shading that is desired. This feature is sometimes called "bit expansion". This "bit expansion" feature is incorporated in an integrated circuit graphics processing unit, Model 32207, manufactured by AT & T.

The development of frame-buffer memories as an extension of the memories utilized in general-purpose computers was discussed above. In general-purpose computers, the contents of the memory are normally left unchanged after a read operation. This is because when it is desired to change the data in the computer's memory, the new data is simply written over and replaces the existing data. It is not surprising, therefore, that the above-data. identified integrated circuit graphics processing unit provides only a single mode of operation for all of the planes in the frame-buffer memory. Accordingly, when the figure stored in the draw plane is being written into the other planes of the memory, the frame-buffer memory system is in a SET mode.

Frame-buffer memories have different requirements from the memories for general-purpose computers. A common approach for the operation of the drawing processor is to use Bresenham's algorithm. In this approach, the drawing processor accesses a word from memory which contains the first bit of the line to be drawn, modifies the word and writes it back to memory. The drawing processor then calculates the word containing the next bit on the line and repeats the process until the entire line is drawn. If a multidimensional memory array is utilized to permit shading or coloring of the line, then the word in each plane of the memory which contains a bit of the line to be drawn must be accessed and modified. It is necessary to read the word in memory because that word may contain a bit which is representative of another line of the drawing. If we only SET a bit representative of the new line which we wish to draw, then when we write this bit into the memory, the other bits in the word would be cleared to 0 which would result in a portion of the other line of the drawing being removed.

The impact of this requirement is that before a new figure can be drawn, the old figure must be cleared so that no remnants of that figure will appear in the new figure to be drawn. In frame-buffers built with the known memory controllers, this requires a separate erase cycle in which each word in the frame-buffer memory is accessed and cleared to zero.

SUMMARY OF THE INVENTION

It is the general object of the present invention to provide a method and apparatus for a copy mode in a frame-buffer memory.

Another object of the invention is to provide a frame-buffer memory having the ability to copy a figure from one plane of the memory to preselected other planes while clearing the first plane and a method for operating same.

A further object of the invention is to provide a frame-buffer memory having the ability to copy a figure from an "invisible" portion of the memory to the "visible" portions of preselected memory planes.

These and other objects and features are attained in accordance with one aspect of the invention by a method of operating a frame-buffer memory for refreshing the image on a raster-scanned display device. The memory comprises a plurality of identically organized planes, each of said planes storing one bit of data corresponding to each pixel of the image in the same relative position. An image is drawn in a first one of the memory planes. The image is read from the first memory plane and written to selected memory planes other than the first memory plane. The image stored in said first memory plane is simultaneously erased.

Another aspect of the invention includes a frame-buffer memory for refreshing the image on a raster-scanned display device. The memory comprises a plurality of planes each storing one bit of a word which represents one pixel of the display. Means draws an image in a first one of the memory planes. Means reads the image from the first memory plane. Means writes said image to selected memory planes other than said first memory plane. Means simultaneously erases the image stored in said first memory plane.

Yet another aspect of the invention includes a multiple-plane frame-buffer memory of a computer graphics system for refreshing an image on a raster-scanned display device. Means reads an image from a first plane of said memory. Means places the memory planes other than the first plane into the SET mode. Means places the first plane into the CLEAR mode. Means SETS the bits representative of said image in preselected ones of said other planes and simultaneously CLEARS the bits representative of said image in said first plane.

A further aspect of the invention includes a multiple-plane frame-buffer memory of a computer graphics system for refreshing an image on a raster-scanned display device. Means writes a symbol in an "invisible" portion of a first plane of the memory. Means writes the symbol into a "visible" portion of selected memory planes other than said first plane.

DETAILED DESCRIPTION

Figure 1:
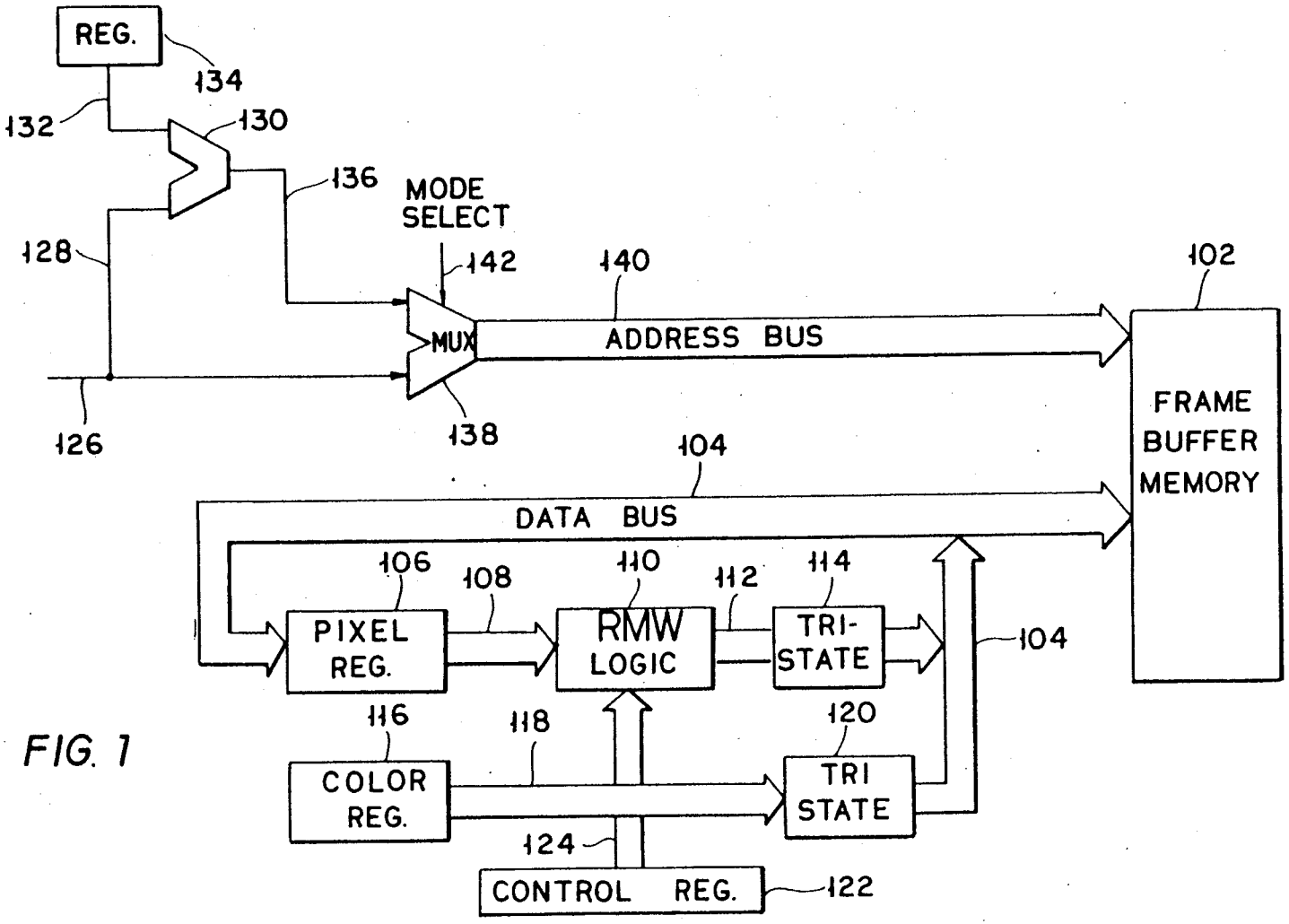
FIG. 1 is a block diagram of a frame-buffer memory system incorporating the present invention.

Referring to FIG. 1, a frame-buffer memory subsystem which incorporates the present invention is generally shown as 100. The subsystem comprises a frame-buffer memory 102 which is coupled by bidirectional data bus 104 to pixel register 106. The output of pixel register 106 is coupled via bus 108 to RMW logic 110. Also coupled to RMW logic 110 is the output of control register 122 via bus 124. The output of RMW logic 110 is coupled via bus 112 through tri-state logic buffer 114 to the bidirectional data bus 104. Also coupled to the bidirectional data bus 104 is the output of color register 116 which is coupled to the bus 104 via data bus 118 and tri-state buffer 120. In the preferred embodiment of the present invention, the entire system, with the exception of the frame-buffer memory 102, can be a portion of a single integrated circuit custom CMOS gate array.

Frame-buffer memory 102 is a three-dimensional memory having, for example, 12 memory planes. In operation, the desired figure is drawn into one of the planes which is selected as the copy plane, by means not shown. The means necessary to draw a figure into a plane of a frame-buffer memory is well known to those skilled in the art and need not be described here. One such means is shown in copending U.S. application Ser. No. 939,057 filed Dec. 8, 1986, which is incorporated herein by reference.

Once the figure is completely drawn in the copy plane, the data from that plane is read out over data bus 104 into pixel register 106 which acts as a holding register. This data is presented to the RMW logic via bus 108. The RMW logic 110 is the logic necessary to perform the read-modify-write cycle for the data stored in the frame-buffer memory. Logic 110 is controlled by the information stored in control register 122 and coupled to the RMW logic 110 by bus 124. The modified data is output onto bus 112 and passes through tri-state buffer 114 to bidirectional data bus 104. This data is then coupled to the frame-buffer memory 102 and written into the desired planes. This will be explained in more detail below. At this time, tri-state buffer 120 is in its high impedence state and the color register 116 is decoupled from data bus 104.

Control register 122 is a 12-bit register which resides within the CMOS gate array in the preferred embodiment of the invention. It is set to any value under program control by writing data to a predefined address, by means not shown. The individual bits of control register 122 are used to control specific parts of the graphic subsystem. The bits that are used to control the functions which are described below are shown in Table 1.

TABLE 1

| Bit Number | | | | |
|---|---|---|---|---|
| 3 | 1 | 0 | 8 | |
| Designation | | | | |
| Mode 3 | Mode 1 | Mode 0 | M00 | Draw Operation |
| 0 | 0 | 0 | x | SET |
| 0 | 0 | 1 | x | CLEAR |
| 0 | 1 | 0 | x | COMPLEMENT |
| 0 | 1 | 1 | 0 | COPY SET |
| 0 | 1 | 1 | 1 | COPY CLEAR |
| 1 | 0 | 0 | x | BIT BLOCK TRANSFER SET |
| 1 | 1 | 0 | x | BIT BLOCK TRANSFER COMPLEMENT |
| 1 | 1 | 1 | x | BIT BLOCK TRANSFER COPY SET |

Figure 2:
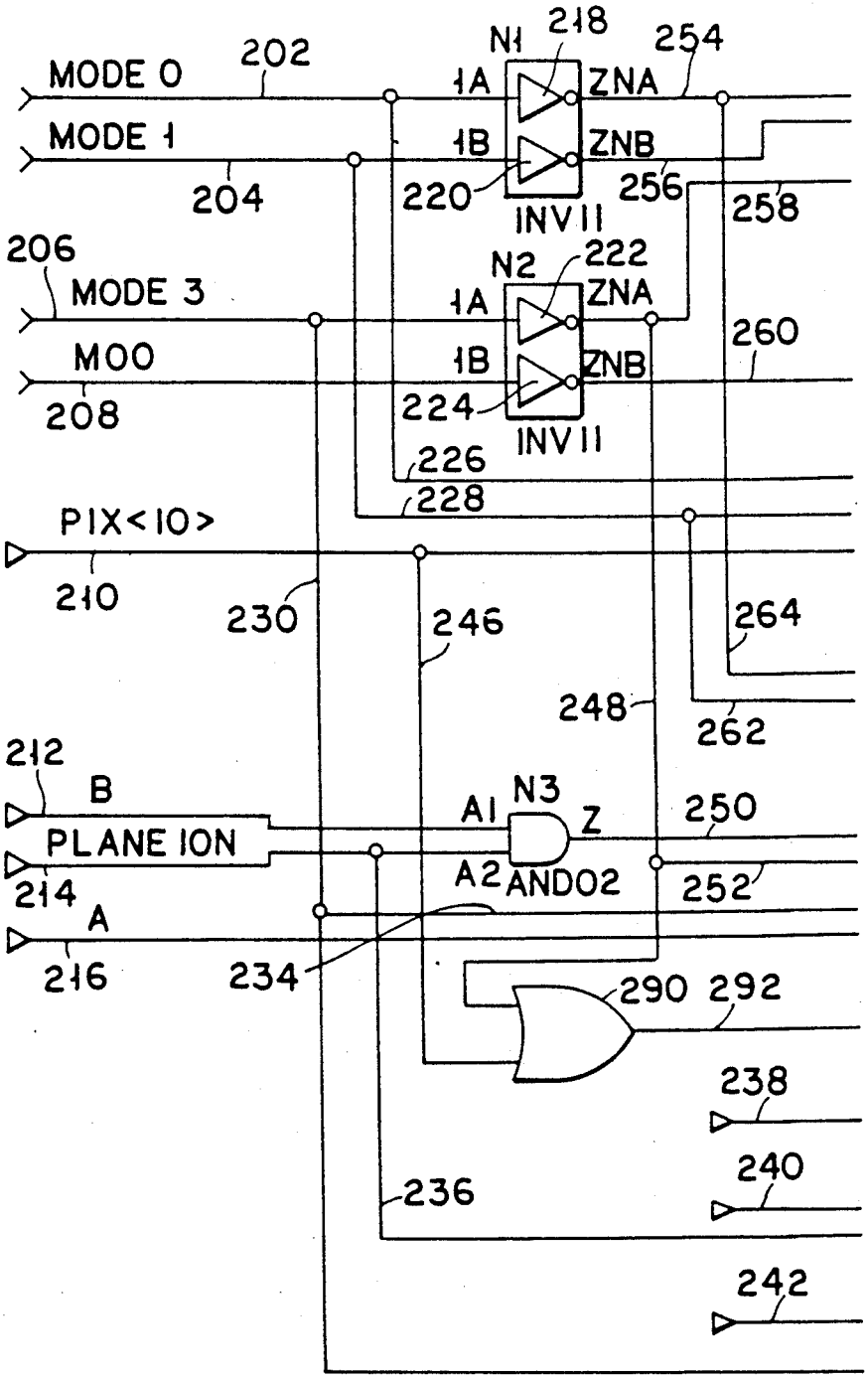
FIG. 2 is a schematic diagram of a portion of the read-modify-write and the control logic for the system.
Figure 2:
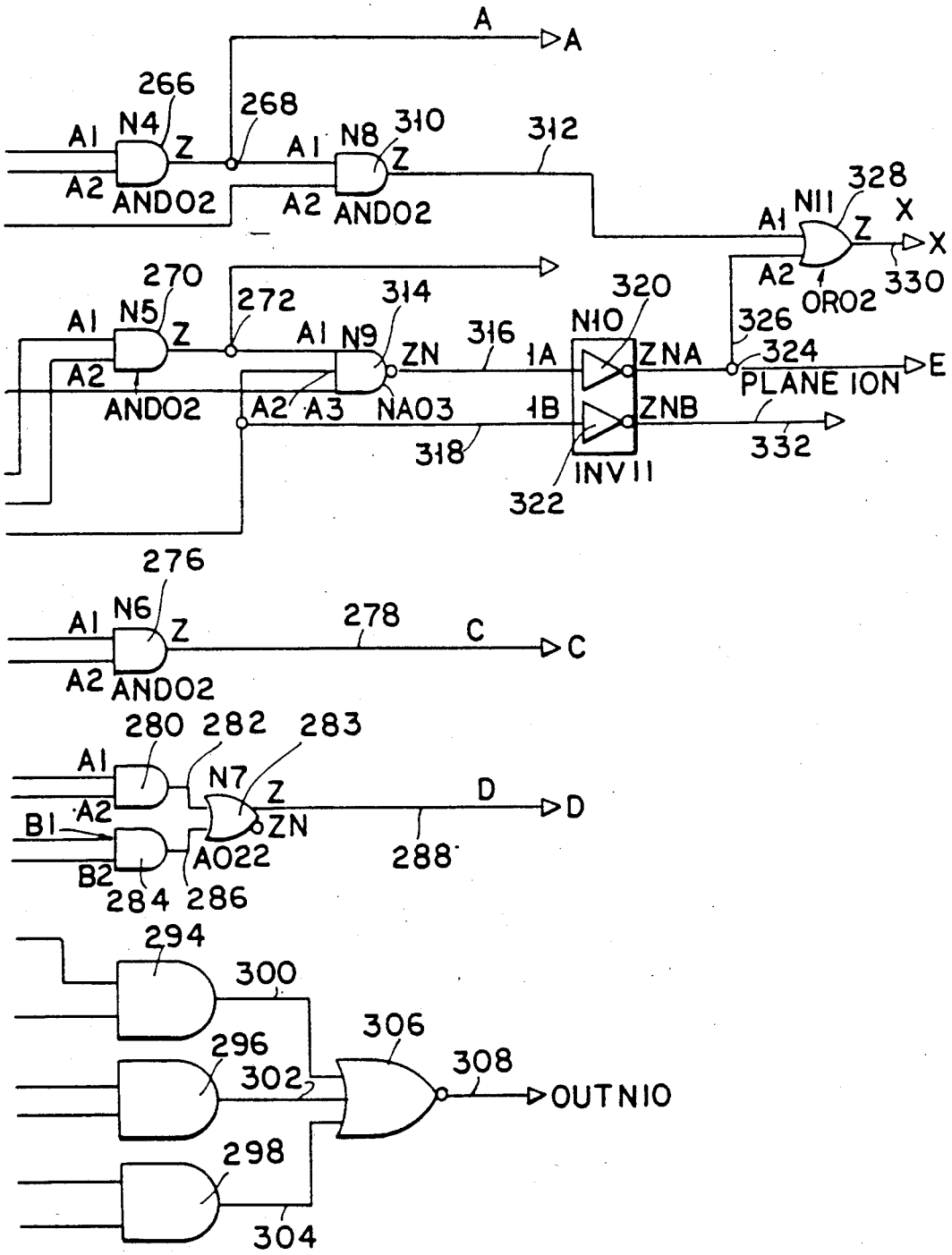
Figure 3:
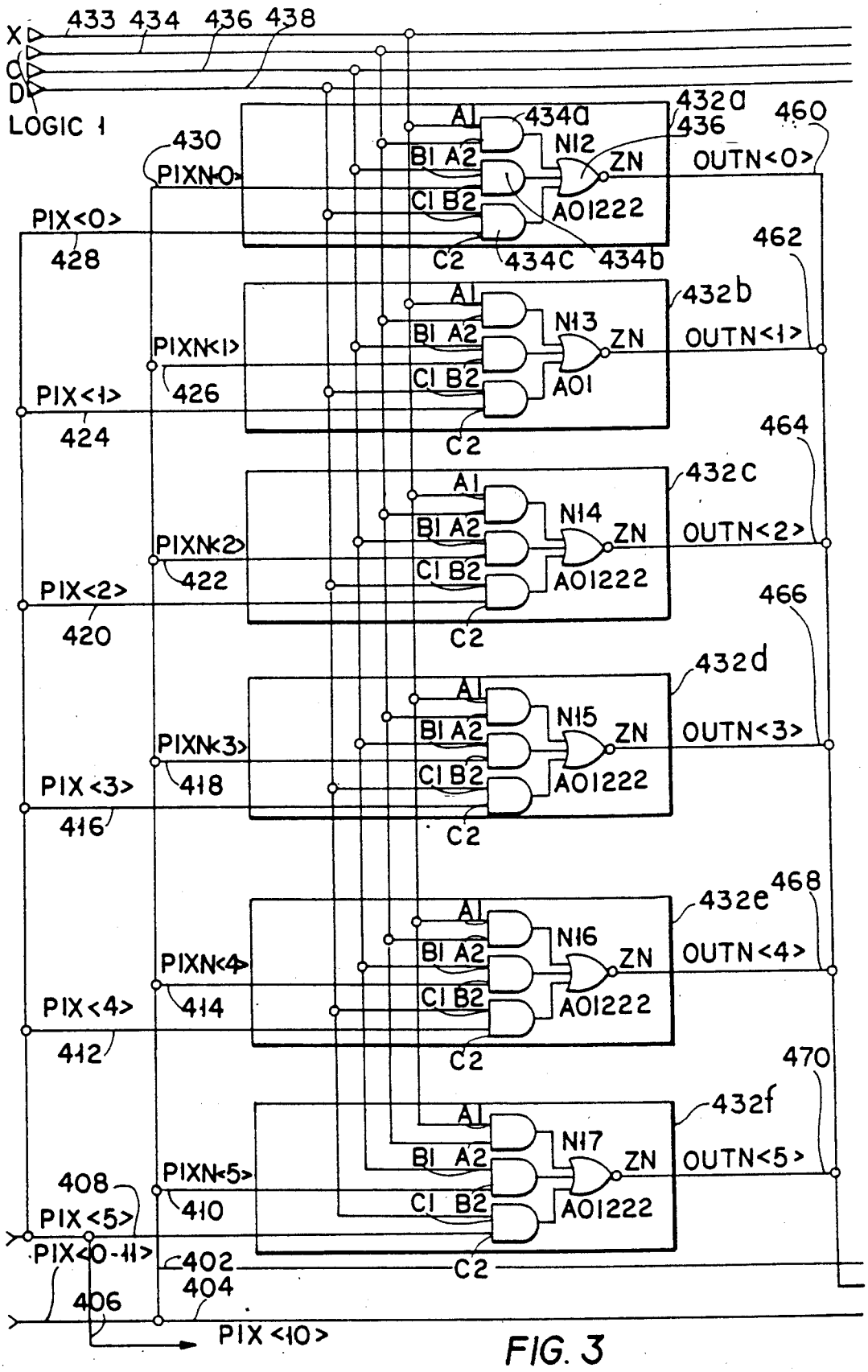
FIG. 3 is a schematic diagram of the read-modify-write logic for the planes other than the copy plane.
Figure 3:
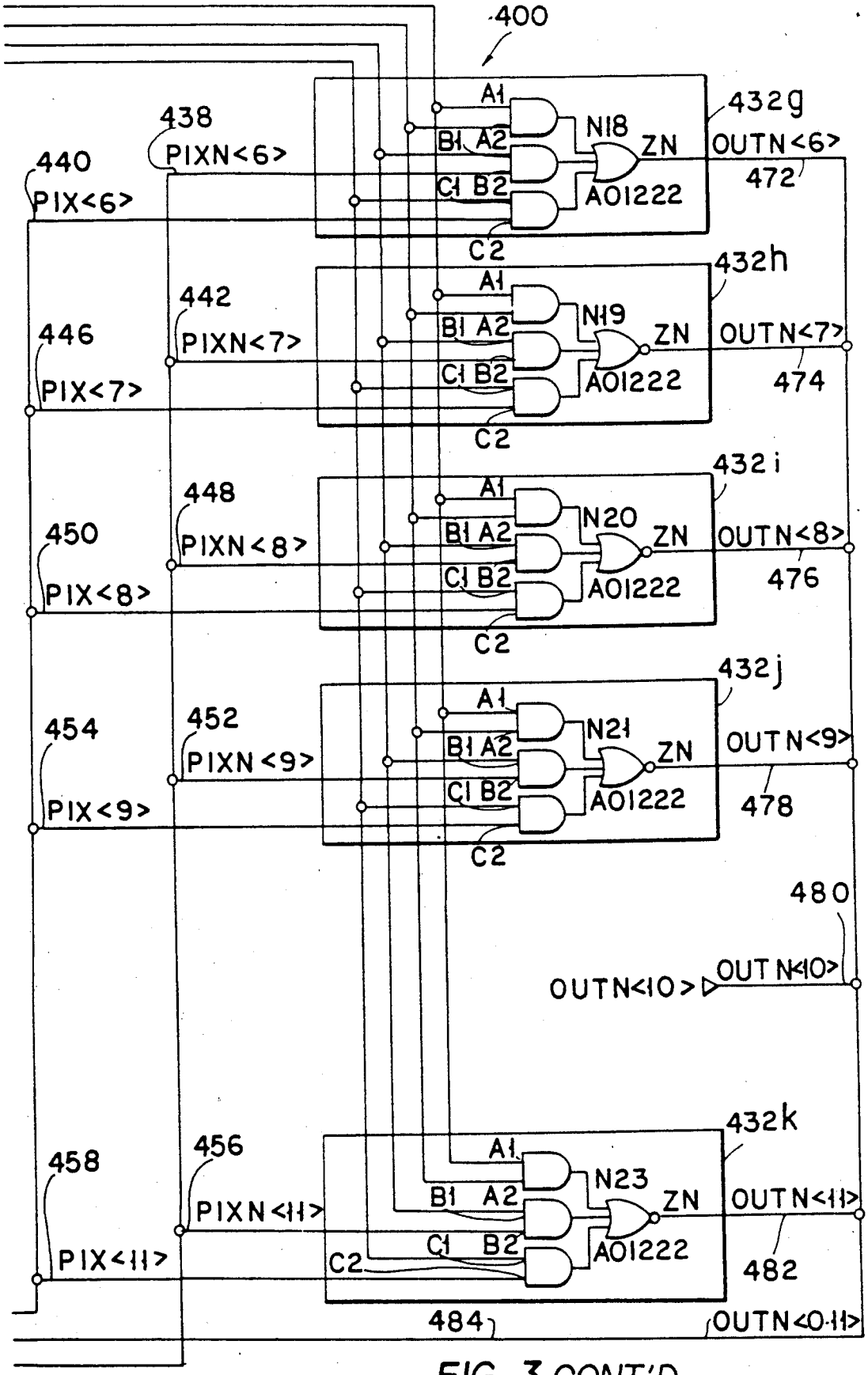

The designations shown in Table 1 are utilized in the logic drawings of FIGS. 2 and 3. In addition, an "x" denotes a "don't care" state.

Before proceeding with a description of RMW logic, it is necessary to understand that data is transferred only to those planes which are enabled. The plane enable is controlled by data stored in color register 116. This data is transferred via bus 118 through tri-state buffer onto bidirectional bus 104 during the appropriate portion of the cycle and comprises one bit per plane of the frame-buffer memory. In the illustrated embodiment, 12 bits of data are utilized. In this mode of operation, tri-state buffer 120 allows the data to pass through to bus 104 and tri-state buffer 114 is in its high impedance state to isolate the RMW logic output on bus 112 from the bidirectional bus 104. The planes which will be enabled depend on the coloring and/or shading that is desired on the figure to be drawn. For example, if bits one, two and three of the word which defines the color of the pixel denotes the color white, then planes one, two and three will be enabled and the set operation will write a logic 1 into the appropriate locations in those planes. The resulting figure will then be drawn in white. This enables one figure to be drawn on top of another which can be utilized to determine when one portion of a printed circuit board wiring crosses another or one portion of an integrated circuit intrudes into another. The data stored in the color register can be written into that register by the host computer for the computer graphics system, for example, by means not shown.

Also shown in FIG. 1 is the bit block transfer circuitry which includes adder 130, destination address offset register 134 and multiplexer 138. The source address bus 126 carries the address of the location in the frame-buffer memory 102 to be read or written into. This bus is applied to one input of multiplexer 138. The bus 126 is also coupled to one input of adder, the other input being coupled to destination address offset register 134. Destination address offset register 134 contains the address offset for the new location to which the bits are to be transferred. The output of adder 130 on bus 136 is coupled to the second input of multiplexer 138. Multiplexer 138 is controlled by a signal on line 142 from means not shown. This signal determines whether the source address is passed to address bus 140 with or without modification. If the source address is unmodified, the system operates normally. Modification of the source address implements a bit block transfer. The detailed operation of the circuitry to perform a bit block transfer is well known to those skilled in the art and need not be described in detail here.

The frame-buffer memory can store symbols or icons in a portion of a memory plane which is not utilized to refresh the display. For example, the plane could have the capacity to store more pixels than found on the display. The data stored in this extra or "invisible" memory can be transferred to the portion of the memory that is used to refresh the screen (the "visible" memory). If the bit block transfer function is combined with the copy mode, then the symbol can be transferred from the "invisible" portion of the copy plane to the "visible" portion of selected planes in the frame-buffer memory. This allows a monochrome or unshaded symbol to be displayed in color and/or with shading in a single step.

Referring now to FIG. 2, the logic for generating some of the signals utilized in controlling the mode of operation of the RMW logic and the logic for driving the copy plane, here designated as plane 10, is shown generally as 200. Bit number 3 of control register 122 and designated "MODE3" is coupled by bus 124 to logic 110 and applied to line 206. Similarly, bit 1, designated "MODEl", is applied to line 204, bit 0, designated "MODE0", is applied to line 202 and bit 8, designated "M00", is applied to line 208. The signal on line 202 is inverted by inverter 218 the output of which is present on line 254. The signal on line 204 is inverted by inverter 220 the output of which appears on line 256. Inverters 218 and 220 are shown within a block to indicate that they are part of a single cell of the custom gate array in which this logic is implemented in the preferred embodiment. The signals on line 254 and 256 are applied to the inputs of a two input AND gate 266 the output of which appears on line 268 which becomes signal "A" and is also coupled to one input of two input AND gate 310. Similarly, the signal on line 206 is inverted by inverter 222 the output of which appears on line 258 which is coupled to the other input of two input AND gate 310. The output of AND gate 310, which appears on line 312, is coupled to one input of two input OR gate 328. The output of gate 328 appears on line 330 and becomes signal "X".

The signals on lines 202 and 204 are coupled by lines 226 and 228, respectively, to the inputs of two input AND gate 270. The output of gate 270 appears on line 272 and becomes the signal "B" which is also coupled to the first input of three input NAND gate 314. The signal on line 208 is inverted by inverter 224 the output of which appears on line 260 which is coupled to the second input of three input NAND gate 314. The third input to NAND gate 314 is the "PIX10" signal on line 210. This signal is the 10th bit of the data stored in pixel register 106 and coupled to the read-modify-write (RMW)logic by bus 108. This signal is also coupled via line 318 to inverter 322, the output of which appears on line 332 which becomes the inverted plane 10 signal designated "PLANE10N". The output of gate 314 appears on line 316 which is inverted by inverter 320 and appears on line 324 to become signal "E". This signal is also coupled ,.via line 326 to the other input of two input OR gate 328, the output of which becomes signal "X" on line 330. The signal on line 254 is coupled via line 264 to one input of two input AND gate 276. The other input of gate 276 is coupled via line 262 to the signal on line 228 which is the MODEl signal on line 204. The output of gate 276 is the "C" signal on line 278. Signals C and X are utilized by the logic illustrated in FIG. 3. Signals A, B, and E are utilized by the logic shown at the bottom of FIG. 2 to generate signal "D" and the data signal to plane 10 labeled "OUTN10". Signal B is applied via line 212 to one input of two input AND gate 232. The PLANE10N signal is applied via line 214 to the other input of this gate. The output of this gate appears on line 250 which is coupled to one input of two input AND gate 280. The other input of gate 280 is coupled via line 252 to line 248 to line 258 which carries the inverted MODE3 signal. Signal A is coupled via line 216 to one input of two input AND gate 284. The other input of gate 284 is coupled via lines 234 and 230 to the uninverted MODE3 signal. The output of gate 280 is coupled via line 282 to one input of two input 0R gate 283, the other input of which is coupled via line 286 to the output of gate 284. The output of gate 283 appears on line 288 as signal "D". This signal is also utilized by the logic shown in FIG. 3. One input of two input OR gate 290 is coupled via line 248 to the inverted MODE3 signal. The other input is coupled via line 246 to the PIX10 signal on line 210. The output of gate 290 is coupled via line 292 to one input of two input AND gate 294. The other input to gate 294 is the A signal on line 238. One input to AND gate 296 is the C signal on line 240. The other input is coupled via line 236 to the PLANE10N signal on line 214. One input of two input AND gate 298 is coupled via line 242 to the E signal, the other input is coupled via line 230 to the uninverted MODE3 signal on line 206. The output of gate 294 is coupled via line 300 to one input of three input NOR gate 306. The output of gates 296 and 298 are coupled to the other inputs of gate 306; by lines 302 and 304, respectively. The output of gate 306 on line 308 is the OUTN10 signal which is the data signal for plane 10.

The operation of the logic diagram shown in FIG. 2 can easily be understood by one skilled in the art without a detailed explanation. The signals MODE0, MODEl, MODE3 and M00 are shown in Table 1. All of the other signals are generated by the logic shown in FIG. 2. Line 308, labeled "OUTN10" is the output signal to plane 10 which determines whether a 1 or a 0 will be written into the plane during the write operation.

There are two copy modes shown in Table 1. The first of these is the "copy SET" mode and the second mode is the "copy CLEAR" mode. These two modes will now be explained in detail. The copy SET mode has a code of 0110. The signals MODE0 and MODEl applied to lines 202 and 204 respectively, are digital 1. These signals are inverted by inverters 218 and 220, respectively, and the digital zeroes are applied to the inputs of gate 266. The output of gate 266, which is signal A, will therefore be a 0. The MODE3 signal, which is also a 0 is inverted by inverter 222 and applied via line 258 to the second input of AND gate 310. The first input to gate 310 is signal A which is a logic 0. Accordingly, the output of gate 310 on line 312 is a 0 which is applied to one input of OR gate 328. The M00 signal is a logic 0 which is inverted by inverter 224 to place a logic 1 on line 260 which is one input to three input AND gate 314. The first input to gate 314 is signal B which is generated by AND gate 270. The inputs to gate 270 are the MODE0 and MODEl signals which are digital ones. The output of the gate will therefore be a 1. The third signal applied to gate 314 is the PIX10 signal. As will be explained below in connection with FIG. 3, this signal is the output for plane 10 from the pixel register shown in FIG. 1. Accordingly, the output of gate 314 on line 316 will toggle with the value of PIX10. This signal is inverted by inverter 320 and applied to line 324 which is signal E. Signal E is also applied to the other input of gate 328 which causes the output on line 330, signal X, to also toggle with the PIX10 input. Signal A is applied to one input of two input AND gate 294. Because this signal is a logic 0, the gate is disabled and the output on line 300 will also be a 0. Similarly, signal C is applied to one input of gate 296 disabling that gate. The MODE3 signal is applied to one input of gate 298, disabling that gate. Therefore, all three inputs to three input NOR gate 306 are logic zeroes, causing the output to be a logic 1. This signal on line 308 is applied to plane 10 and is active to cause it to be erased regardless of the operations performed on the other planes.

In the copy CLEAR mode, only signal M00 changes from a digital 0 to a digital 1. This disables logic gate 314 and forces signal E to a logic 0. However, the MODE3 signal is still coupled to the other input of gate 298, so that the situation is unchanged and plane 10 will still be erased.

Referring to FIG. 3, the logic which provides the read-modify-write (RMW) control logic for the other 11 Planes is shown generally as 400. The pixel register 106, shown in FIG. 1, provides the inverted and noninverted outputs of the register on bus 108. The noninverted outputs appear on bus 402 and the inverted outputs appear on bus 404. The non-inverted signal for plane 10 is coupled via line 406 to line 210 of FIG. 2. In addition the signals X, C, and D, generated in FIG. 2 are coupled to this logic via lines 433, 436 and 438 respectively. The signal on line 434 is a logic 1 signal which could be provided by a pull-up resistor, for example.

The control logic for each of planes 0–9 and 11 is identical and consists of 3 two input AND gates, the outputs of which are coupled to a three input NOR gate. The structure for planes 0 through 11 are labelled 432*a* through 432*k*. The logic for plane 10 is not shown on FIG. 3 because special control logic is utilized for this plane which is shown in FIG. 2 and discussed above. Block 432*a* is discussed in detail. The operation of the other blocks is identical except that they apply to a different plane. Block 432*a* comprises two input AND gate 434*a* having one input coupled to the X signal on line 433. The other input to gate 434*a* is coupled to the logic 1 signal on line 434. Thus, the output of the gate will toggle with the signal X in the copy mode. This in turn will cause the output of the three input NOR gate 436 to toggle with the signal X. The signal is output on line 460 which becomes the output signal to plane 0. Thus, the activation of gate 434*a* enables the signal which appears on the PIX10 line 210 (FIG. 2) to be copied onto plane 0.

Gates 434*b* and 434*c* are not utilized in the copy mode. One input of gate 434*b* is coupled to the signal C and the other input is coupled to the inverted output of the pixel register for plane 0, labelled PIXN0. One input of gate 434*c* is coupled to the signal D and the other input is coupled to the non-inverted pixel register output for plane 0 labelled PIX0. Thus, these gates can, for example, be utilized to pass the signal through to the plane or to complement the signal and pass it through the plane. The outputs of each of these gates is coupled to one input of the three input NOR gate 436 which produces the inverted output signal OUTN0 for plane 0. Line 460 is coupled to the output bus 484 which goes to the planes 0 through 11.

Similarly, logic circuit 432*b* is coupled to the input lines 424 and 426 for plane 1, and the output line 462 for plane 1. Logic circuit 423*c* is coupled to input lines 420 and 422 and output line 464, logic circuit 432*d* is coupled to input lines 416 and 418 and output line 466, logic circuit 432*e* is coupled to input lines 412 and 414 and output line 468, logic circuit 432*f* is coupled to input lines 408 and 410 and output line 470; logic circuit 432*g* is coupled to input lines 438 and 440 and output line 472, logic circuit 432*h* is coupled to lines 442 and 446 and input line 474, logic circuit 432*i* is coupled to input lines 448 and 450 and output line 476, and logic circuit 432*k* is coupled to input lines 456 and 458 and output line 482. All of the output lines are coupled to the bus 484 which couples the signals to their respective plane. Line 480 couples the signal OUTN10 from FIG. 2 to the output bus 484.

While a particular embodiment of the present invention has been disclosed herein, certain changes and modifications will readily occur to those skilled in the art. All such changes and modifications can be made without departing from the invention as defined by the appended claims.

We claim:

1. A method of operating a frame-buffer memory for refreshing an image on a raster-scanned display device, said memory comprising a plurality of identically organized planes, a first one of said plurality of planes being operable as an independent drawing plane, a remainder of said plurality of planes being operable to refresh said display, each of said planes operable for refreshing said display storing one bit of data representing each pixel of said image at a relative position, said drawing plane storing one bit of data associated with each pixel at said relative position, the method comprising:

(a) drawing an image in a first one of said memory planes;

(b) reading said image from said first memory plane to a temporary storage means;

(c) selectively enabling memory planes other than said first memory plane for receiving said image for receiving said image;

(d) writing said image from said temporary storage means to said enabled memory planes;

(e) simultaneous with step d writing a constant to said first memory plane to thereby erase the image stored in said first memory plane; and (f) refreshing said raster-scanned display device from said enabled memory planes other than said first memory plane.

2. A frame-buffer memory for refreshing an image of a raster-scanned display device, said memory comprising a plurality of identically organized planes, a first one of said plurality of planes being operable as an independent drawing plane, a remainder of said plurality of planes being operable to refresh said display, each of said planes operable for refreshing said display storing one bit of data representing each pixel of said image at a relative position, said drawing plane storing one bit of data associated with each pixel at said relative position, said frame-buffer memory comprising:

(a) means for drawing an image in a fist one of said memory planes;

(b) means for reading said image from said first memory plane to a temporary storage means;

(c) means for selectively enabling memory planes other than said fist memory plane for receiving said image for receiving said image;

(d) transfer means for writing said image from said temporary storage means to said enabled memory planes;

(e) means operable simultaneously with said transfer means for writing a constant to said first memory plane to thereby erase the image stored in said first memory plane; and (f) means for refreshing said raster-scanned display device from said enabled memory planes other than said first memory plane.

3. In a computer graphics system, a multiple-plane frame-buffer memory for refreshing an image on a raster-scanned display device, said memory comprising a plurality of identically organized planes, a first one of said plurality of planes being operable as an independent drawing plane, a remainder of said plurality of planes being operable to refresh said display, each of said planes operable for refreshing said display storing one bit of data representing each pixel of said image at a relative position, said drawing plane storing one bit of data associated with each pixel at said relative position, said frame buffer memory comprising:

(a) means for reading an image from a fist plane of said memory into a temporary storage means;

(b) means for selectively placing one or more predetermined memory planes other than said first plane into a SET mode in which addressed bits of said predetermined memory planes represent a refreshed image;

(c) means for placing said first plane into a CLEAR mode in which said image represented by addressed bits will be removed;

(d) means for SETTING the bits representative of said image stored in said temporary storage means in said predetermined memory planes and simultaneously CLEARING the bits representative of said image in said first plane; and (e) means for refreshing said refreshed image on a raster-scanned display device from said predetermined memory planes other than said first memory plane.

4. The computer graphics system of claim 3 further comprising:

means for writing a symbol in an invisible portion of said first plane of said memory; and means for copying said symbol into a visible portion of a predetermined memory plane other than said first plane.

* * * * *